US008523493B2

(12) United States Patent
Gunther et al.

(10) Patent No.: US 8,523,493 B2
(45) Date of Patent: Sep. 3, 2013

(54) MODIFIED STORAGE POD AND FEEDING SYSTEM FOR BINDER UTILIZED FOR IN-SITU PILINGS AND METHOD OF UTILIZING THE SAME

(76) Inventors: Johan Gunther, Santa Monica, CA (US); David Blomqvist, Bangkok (TH); Henrik Persson, Bangkok (TH)

( * ) Notice: Subject to any disclaimer, the term of this patent is extended or adjusted under 35 U.S.C. 154(b) by 929 days.

(21) Appl. No.: 12/640,911

(22) Filed: Dec. 17, 2009

(65) Prior Publication Data

US 2010/0329797 A1 Dec. 30, 2010

Related U.S. Application Data

(60) Provisional application No. 61/203,084, filed on Dec. 17, 2008.

(51) Int. Cl.
*E02D 5/00* (2006.01)
*B01F 13/02* (2006.01)

(52) U.S. Cl.
USPC ..... 405/233; 366/101

(58) Field of Classification Search
USPC ..... 405/233; 366/101, 106, 107, 173.1, 366/173.2; 406/88, 89, 90, 91, 107
See application file for complete search history.

(56) References Cited

U.S. PATENT DOCUMENTS 2,715,551 A * 8/1955 Kiernan ..... 406/75
2,919,159 A * 12/1959 Lacroix ..... 406/137
3,001,829 A * 9/1961 De Saint-Martin Lucien . 406/90
3,542,342 A 11/1970 Barron
4,089,563 A * 5/1978 Neu ..... 406/125
4,815,414 A * 3/1989 Duffy et al. ..... 118/308
4,941,779 A * 7/1990 Dewitz et al. ..... 406/138
5,106,240 A * 4/1992 Dirkse et al. ..... 406/138
5,503,473 A 4/1996 Dearing, Sr. et al.
5,590,958 A 1/1997 Dearing, Sr. et al.
5,634,713 A * 6/1997 Abe ..... 366/102
5,967,700 A 10/1999 Gunther
6,220,791 B1 * 4/2001 Hutchins ..... 406/124
6,685,398 B1 2/2004 Gunther
7,090,436 B2 8/2006 Gunther
7,192,220 B2 3/2007 Gunther
7,341,405 B2 3/2008 Gunther
2004/0233776 A1 * 11/2004 Steele ..... 366/106
2010/0329797 A1 * 12/2010 Gunther et al. ..... 405/233

* cited by examiner

*Primary Examiner* — Tony G Soohoo
(74) *Attorney, Agent, or Firm* — James M. Duncan, Esq.; Klein DeNatale Goldner

(57) ABSTRACT

In a vessel utilized for providing powdered materials, such as binder, for the construction of an in-situ piling, the vessel has a binder feeding system having a fluidization chamber, where the fluidization chamber receives air at a higher pressure than the substantial portion of the remainder of the vessel. This higher pressure enhances the fluidization of the powered materials as the materials are dispersed through an actuated valve at the bottom of the vessel. This system results in a decreased volume of air required for transporting the powdered materials through the feeder hose to the tool in the piling borehole, thereby reducing the creation of air pockets in the in-situ piling. This feeder system replaces the cell wheel currently used in binder feeder systems.

4 Claims, 6 Drawing Sheets

MODIFIED STORAGE POD AND FEEDING SYSTEM FOR BINDER UTILIZED FOR IN-SITU PILINGS AND METHOD OF UTILIZING THE SAME

CROSS-REFERENCE TO RELATED APPLICATIONS

U.S. Provisional Application No. 61/203,084 was filed on Dec. 17, 2008, for which these inventors claim domestic priority.

BACKGROUND OF THE INVENTION

The present invention is generally related to the field of pilings utilized for the support of above grade structures, and specifically to the creation of in-situ pilings by the disposition of binding material, or binder, within a borehole by a tool assembly. Together with a portion of the soil whose volume it replaces, and water which is either added or already present in the borehole, the binder forms an in-situ piling which is used as an alternative to conventional pilings. The finely powdered binder is typically transported to the tool assembly from a bulk storage container or pod by blowing air into the pod and the delivery lines. However, one factor which can adversely impact the integrity of an in-situ piling is pockets or void spots resulting from air entrained within the binder. It is desirable to deliver the binder to the borehole with a minimal volume of air.

SUMMARY OF THE INVENTION

The present apparatus and method approach the problems associated with excessive air in the binder by reducing the amount of air introduced into the binder for fluidization for transport. This air is introduced, by necessity, as a transport mechanism for conveying the binder from its supply pod, through surface hoses, and through the boring-mixing type tool into the subsurface.

The disclosed apparatus provides an improved mechanism which assists in controlling the uniformity and predictability of the structural properties of in-situ pilings. The disclosed apparatus may be used as a replacement for known feeder systems for binder materials utilized in fabricating in-situ pilings. The known feeder systems typically comprise a cell wheel and feeder box located at the bottom of the storage pod. The pod is pressurized, and binder is delivered to the transport hose by the rotation of the cell wheel. This type of feeder system, for the reasons explained further below, can result in excessive air being entrained within the binder.

The disclosed apparatus reduces the amount of air introduced into the binder as required for transporting the binder to the tool 10, thereby decreasing problems which are associated with the presence of excessive air in the fabrication of in-situ pilings. The disclosed apparatus also reduces the maintenance required on the feed mechanisms of containers used for supplying materials utilized in fabricating the in-situ piling. The present invention replaces the binder feeder system currently being utilized with a binder storage pod having a fluidization chamber which, as described below, receives injected air at a slightly higher pressure than the pressure within most of the pod. An actuated valve is located beneath the fluidization chamber. It should be noted that the term "storage pod", as utilized herein, refers to various storage vessels and tanks which are utilized for delivering and/or storing binder and/or other powdered components utilized in the construction of in-situ pilings. Such storage pods may include devices which are mobile and transported either under integral mechanisms, or which are trailer and/or skid mounted.

An embodiment of the storage pod comprises an upper chamber which receives air at a first pressure through a first air inlet. The storage pod further comprises a fluidization chamber disposed beneath the upper chamber where the fluidization chamber receives air through a second pressure by a second air inlet means, the second pressure exceeding the first pressure. An adjustable valve is disposed below the fluidization chamber, where the valves has an inlet end and a discharge end, wherein binder from the fluidization chamber enters the valve through the inlet end and is discharged through the discharge end. The discharge end of the valve is connected to the feeder hose which delivers binder to the tool placed in the borehole. A valve actuator is connected to the adjustable valve which provides for controlled operation of the valve. The valve actuator may be controlled by a digital processor or other device which determines the theoretically required volume of binder at a particular time, based upon various input, such that a controlled binder flow rate may be realized by the controlled throttling of the valve.

BRIEF DESCRIPTION OF THE DRAWINGS AND FIGURES

FIG. 1 schematically shows equipment which may be utilized in constructing in-situ pilings.

FIG. 2 schematically shows an embodiment of a storage pod according to the disclosed invention.

DETAILED DESCRIPTION OF THE EMBODIMENTS

Background of In-Situ Pilings

Underlying supports for above-grade structures are often referred to as "piles" or "pilings". Such structures may also be referred to as "supports". The terms piles, pilings, and supports will, for purposes of this disclosure, be regarded as synonymous. The term "piling" in its general sense is a structure that gives a known vertical response to a load exerted directly on top of it. The familiar construction of a beach-side pier relies on this property. The pier structure is simply built so as to be tied to the top of the pilings and is supported at its underside by the pilings.

A support of the type pertinent to the present invention is formed in-situ below grade and utilizes as part of its composition the soil whose volume it replaces. The structure of an in-situ piling contrasts with conventional supports, which are generally lengths of tree trunk grown and prepared, or cast concrete shapes manufactured elsewhere or on-site from foreign material. Conventional pilings and supports preferably are driven or otherwise placed in direct contact with bedrock or other supporting structures. If the bedrock or other structure is too deep to achieve direct contact, then reliance for support is placed on the "skin friction" between the piling and the surrounding soil.

The inherent advantage of the continuity of an in-situ piling with its surrounding soil is evident. Its equivalent of skin friction is a merger of the surrounding soil with the enhanced material of the in-situ piling. This continuity with the surrounding soil forms a very substantial difference with conventional supports, which is advantageous whether or not the in-situ piling reaches bedrock or other supporting structures or relies on the engagement (for convenience sometimes referred to as skin friction) of the in-situ piling with its surroundings. In fact, the in-situ piling does not have a skin in the same sense as a conventional piling has.

Figure 1:
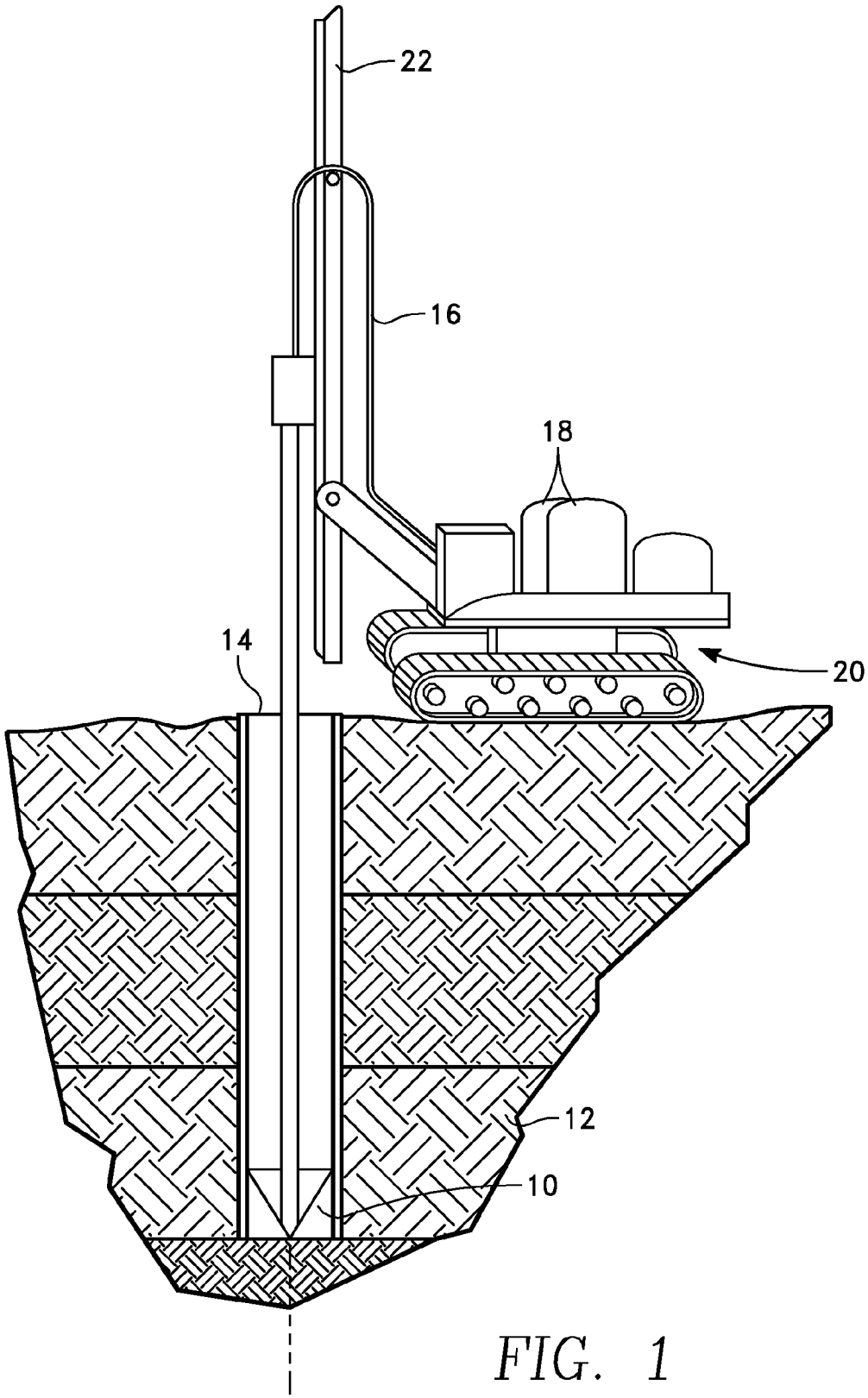

In-situ pilings may be fabricated where the only required materials for delivery to the installation site are water and binder (often cement or lime or both). A boring-mixing tool 10, as schematically shown in FIG. 1, is also brought to the site, which is used to dig into the ground 12 forming a borehole 14. As the borehole is drilled or, alternatively, withdrawn from the borehole, the boring-mixing tool mixes water, or other suitable liquids, and binder into the existing earth material. The intended result is a sub-grade column on which an above-grade structure may rest, existing in the earth without requiring off-site manufacture of the piling or the need to drive the piling into place.

Several methodologies have been proposed for fabrication of in-situ pilings in the manner described above. Perhaps the oldest is often called the "dry method", in which a tool 10 bores into the ground 12 and while so doing adds a binder to the borehole cuttings, where the binder reacts with water already existing in the soil, with it to form a cementitious column. The shortcomings of the dry method are evident. There may not be enough water present for the purpose. Still, the dry process has been widely used, and still is in use to this day.

Another process, commonly called the "wet method", has also been widely used. In this method the binder is provided as a slurry of water and binder, which is injected into the ground 12 while the tool 10 bores into it. There are considerable disadvantages in this system including wastage of binder, variability of the properties of the piling from depth to depth, and clean-up costs, which can be very large.

There have been previous efforts to overcome the disadvantages of the wet and dry methods. One is familiarly called the "modified dry method" in which the soil is preconditioned with water as the tool 10 moves down, and binder is added on the way up. This is the subject of U.S. Pat. No. 5,967,700 issued Oct. 19, 1999, title "LIME/CEMENT COLUMNAR STABILIZATION OF SOILS" to Gunther, an inventor herein. Another previous effort is European patent No. 0411 560 BI granted May 4, 1994 to Trevi S. P. A. which describes an effort to produce an in-situ piling with only sufficient water provided for "humidification".

The current practice for injecting the dry binder into the subsurface region is by entraining it in a pressurized stream of air, i.e., "fluidizing" the binder, which typically occurs when the dry binder is transferred via hose 16 from a storage pod 18 to the bore tool 10. Unavoidably this practice means injecting very substantial volumes of air into the subsurface structure along with the binder. There, unless it can escape, the air can form pockets in the piling which reduce the strength of the column itself. As discussed in Gunther's U.S. Pat. No. 7,341,405, which is incorporated herein in its entirety by this reference, the presence of air adds to the volume of the mix, and a large heaving of surrounding soil will be formed. The '405 patent disclosed a means of providing an environment in which the air would readily percolate out by providing sufficient fluidly (or fluidization) of the mixture through utilizing excess water for fluidization. Alternatively, as disclosed herein, reduction of the entrained air can reduce the volume of air placed in the in-situ piling.

Background to the Known Feeder System and its Disadvantages

Powered (or granular) binder is supplied at the site in bulk transport 20 and held for discharge from the storage pod 18. The amount of binder being dispensed is not detected from a flow-sensing device, but rather from the continuous weighing of the storage pod 18 with its contents. The reason for this measurement method is that flow sensing devices are speedily destroyed by the abrasive binder. The diminishing weight of the storage pod 18 and its contents has been found to be a sufficient measure of the dispensed binder.

The binder is conveyed from the tank or storage pod 18 through a hose 16 extending from the storage pod 18 to the top of a tower 22, and then down to the tool 10, under propulsion of a pressurized air stream. The air enters the bore along with the dry binder. There is typically at least a 40 foot flow path from the tank to the tool. Under the existing known apparatus and method, the binder is fed into the air stream at a rate determined by a feed mechanism such as a cell wheel (also referred to as a star wheel) located at the bottom of the storage pod 18.

The known feed system employed for dispersion of binder from the storage pod 18 into the feeder hose 16 utilizes a cell wheel, which is set below the v-shaped bottom of the pod, where fluidization of the binder, to the extent it occurs, takes place. The cell wheel is rotatably fastened to the bottom of the storage pod 18. The cell wheel has a plurality of pockets or sections in radial arrangement about the wheel. Typically, eight pockets are utilized in the cell wheel. The cell wheel is employed to control the amount of binder injected into the soil. The amount of binder injected can be controlled by altering the speed (rpm) of the cell wheel.

In the known practice for creating in-situ pilings, binder is fed into the cell wheel from the overlying volume of the storage pod 18. As the cell wheel rotates, the binder drops into a "box" or compartment underlying the cell wheel. An air stream is introduced into the box to "fluidize" the binder which has been dropped into the box. The pressure of this air stream is generally the same as the pressure applied to the overlying storage pod 18, such that there is no appreciable pressure differential between the tank pressure and the pressure in the feeder box beneath the cell wheel, aside from the pressure exerted by the height of the overlying binder. The fluidized binder leaves the box through a feeder hose, typically 2 inch diameter, for delivery to the tool 10 located at the subsurface.

Ideally, the rate of feed of the cell wheel is proportional to its rate of rotation. This rotation rate may be under the control of a program which responds to the depth and the known amount of binder desired at that depth based upon the known data. It is desirable to achieve control over the flow rate of the binder because of the impact of binder volume to the properties of the in-situ column, and also to utilize binder in a cost-effective manner. However, with the known feed apparatus, it is difficult to maintain effective control over the binder flow rate. The cell wheel system is only effective at steady state flow rates, with little flexibility for adjustment. If a relatively small flow rate is desired, the cell wheel rotation is slowed. However, a slowly rotating cell wheel allows the introduction of a large volume of air, without binder, into the feeder box and feeder hose, and thus into the piling column, resulting in the problems discussed above. Moreover, because the binder is highly abrasive, the cell wheel is subjected to constant internal wear which abrades the components of the cell wheel and increases the tolerances between the cell wheel and its housing, resulting in a further loss of control of the binder flow rate, and a larger volume of binder to be injected. Alternatively, if a large binder flow rate is desired, a rapidly spinning cell wheel is almost in the way of itself, such that the pockets of the cell wheel cannot be emptied fast enough.

In addition to the problems identified above with the present binder feeder system, the cell wheel system results in a pulsing injection of binder, particularly at lower rotational speeds of the wheel. The pulsing occurs when non-fluidized binder from the cell wheel is "dumped" into the feeder box and impacted by the airstream flowing through the box. In other words, the content of the feeder hose down stream from the feeder may alternatively consist of a low amount of binder followed by a large amount of binder. This pulsing is very undesirable because it interferes with achieving the desired column for the in-situ piling, which often requires being able to control the binder flow rate.

Description of the Present Invention

Figure 2:
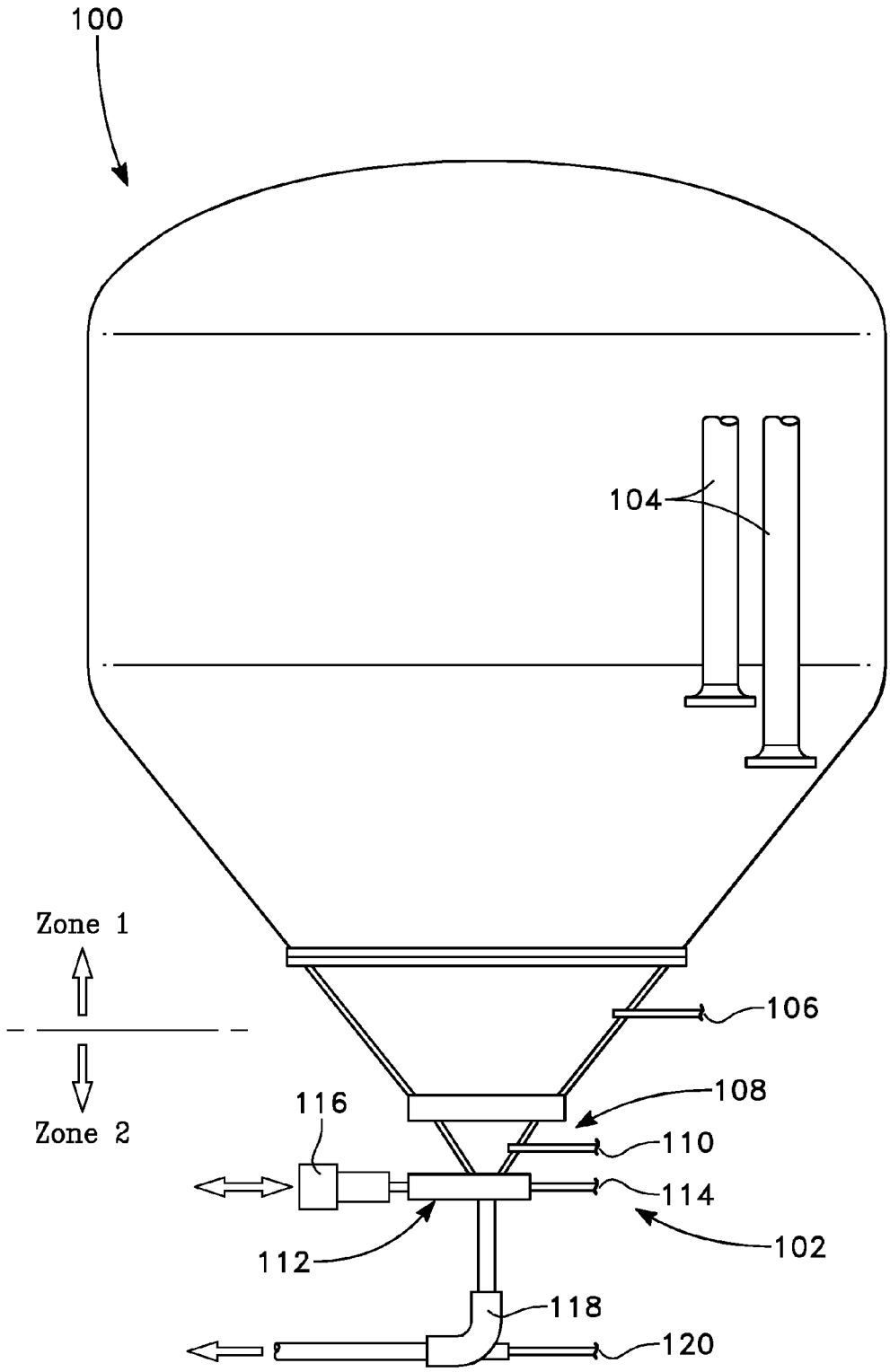

Referring now to FIGS. 2-6, the presently disclosed invention comprises a binder storage pod 100 which comprises a feeder system 102 which replaces the cell wheel-feeder box discussed above. FIG. 2 schematically shows the relation of the storage pod 100 and the general components of the feeder system 102. Storage pod 100 comprises material fill pipes 104, which are utilized to fill the storage pod with binder or comparable material. The substantial portion of storage pod 100, referred to as the upper chamber, indicated as Zone 1, receives air and maintained in a pressurized state by applying air pressure at a first air inlet 106. The storage pod further comprises a lower section called the fluidization chamber 108, which is to be distinguished from the v-shaped bottom of the pod. The fluidization chamber 108 comprises its own air inlet, which is referred to herein as the second air inlet 110 to distinguish it from the first air inlet 106. Disposed below the fluidization chamber 108 is an actuated valve 112. This lower portion of the storage pod 100 may be referred to a Zone 2, and during operation portions of it will have a higher pressure than in Zone 1 because of localized air injection as discussed below.

The actuated valve 112 may be adjusted over a range of openings extending from a first position where the valve opening only allows the passage of a small volume of binder, up to, and including, a fully open position which allows binder flow rates several time larger than the flow rates achievable with the cell wheel. Actuated valve 112 is used in combination with one or more small diameter (e.g., ¼") air injection inlets located in close proximity to the valve, such as second air inlet 110. The small diameter air injection inlets are utilized for injection of air into the fluidization chamber 108 immediately adjacent to the actuated valve 112. Air is injected into second air inlet 110 when the actuated valve 112 is opened. An additional air inlet, referred to third air inlet 114, may be connected directly to the body of actuated valve 112 such that air may be injected directly into the throat of the valve when it is opened. The injection pressure for one, or all, of the air injection inlets 110, 114, is slightly higher, such an additional 10 percent, than the pressure of the air injected into the tank by first air inlet 106. First air inlet 106 is sized to provide a substantially larger volume of air than injection inlets 110, 114. For example, if air inlets 110, 114 are ¼" in diameter, first air inlet 106 may range from 1¼" to 2" in diameter. The actuated valve 112 comprises an actuator 116 which may be hydraulic, pneumatic or electric and may be controlled by a computer or programmable controller utilized for determining the required amount of binder for a particular location in the in-situ column as described in the '405 patent.

In essence, the disclosed feeder system creates two pressure zones within the storage pod 100. The first zone, Zone 1, extends upwardly in the storage pod 100 from approximately first air inlet 106 and comprises a substantial portion of the storage pod, and is approximately maintained at a first pressure $P_1$. The second zone, Zone 2, is located generally around the fluidization chamber 108 is slightly elevated (for example by 10 percent above the first pressure), by the incoming air stream from one or both of the small diameter air injection inlets, 110, 114, which will typically be a significantly smaller diameter than air injection inlet 106. The incoming air stream through air injection inlets 110, 114 is regulated and maintained at a sufficiently small volume such that the overall tank pressure $P_1$ does not equalize to the higher pressure $P_2$ of the second zone. The outlet of actuated valve 112 is connected to feeder line 118. Feeder line 118 receives air at the first pressure $P_1$ from air line 120 when actuated valve 112 is opened such that a small pressure differential exists between the second zone and the feeder line. This differential assists in a flow of fluidized binder through the actuated valve 112 when the valve is opened. For example, the first zone, and the pressure to the feeder line $P_1$, may be maintained at approximately 5 atmospheres of pressure, while the pressure in the second zone $P_2$ may approach 5.5 atmospheres, resulting in a 0.5 atmosphere differential between the fluidization chamber 108 and the feeder line 118. The air injection through the small diameter injection inlets 110, 114 allows for complete fluidization of the binder immediately before the binder is discharged into the feeder line 118 for delivery to hose 16 for transport to bore tool 10. It is to be appreciated that because of the changing level of binder in the storage pod 100, which will impose its own pressure based upon the height of the binder within the pod, and the lack of a physical barrier between Zone 1 and Zone 2, there is not a definitive boundary between the two Zones, but rather a transition between the higher pressure around the fluidization chamber and lower pressure in the upper chamber of the storage pod 100.

Figure 3:
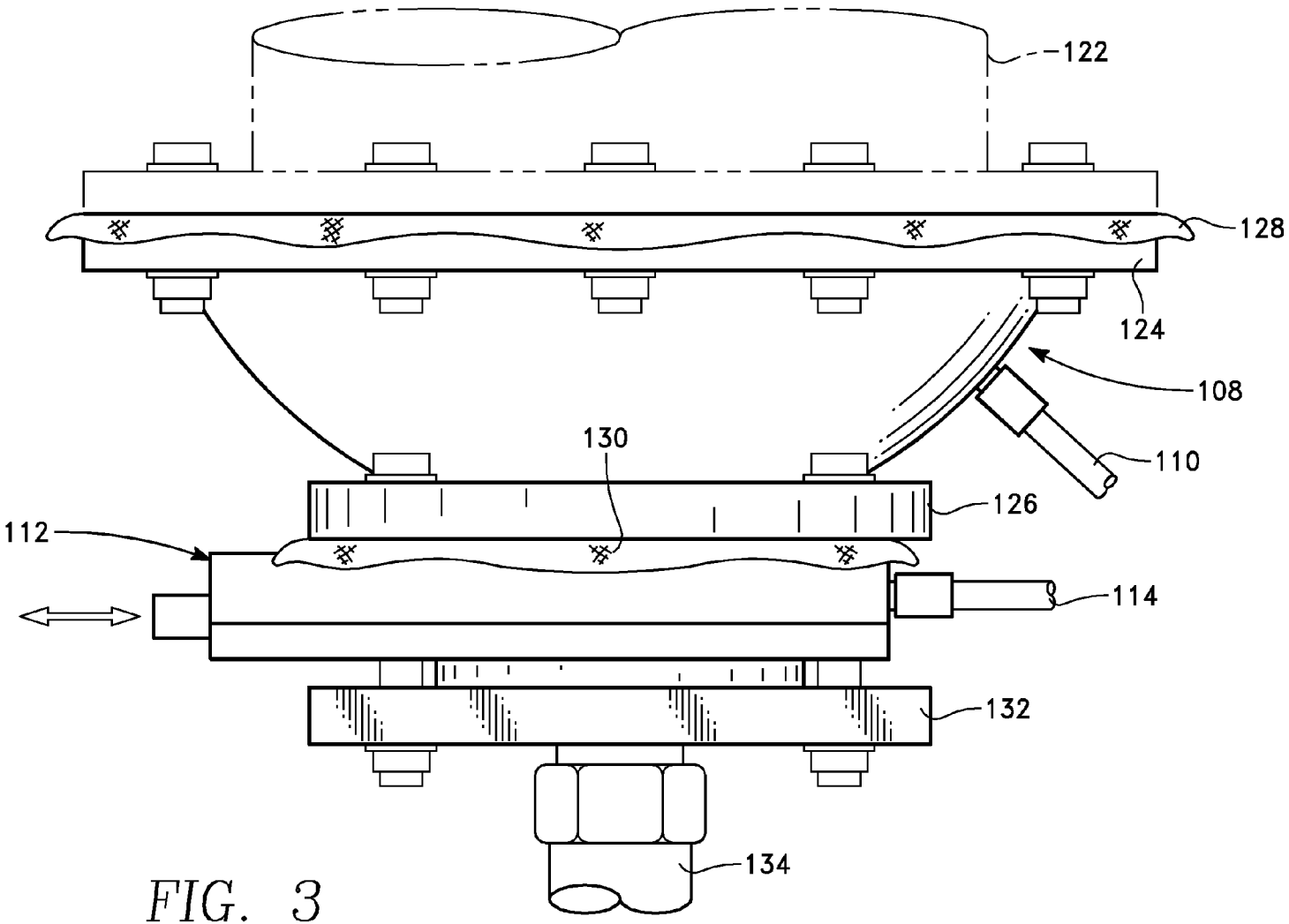
FIG. 3 shows an exterior view of an embodiment of a portion of the binder feeder system according to the disclosed invention.
Figure 5:
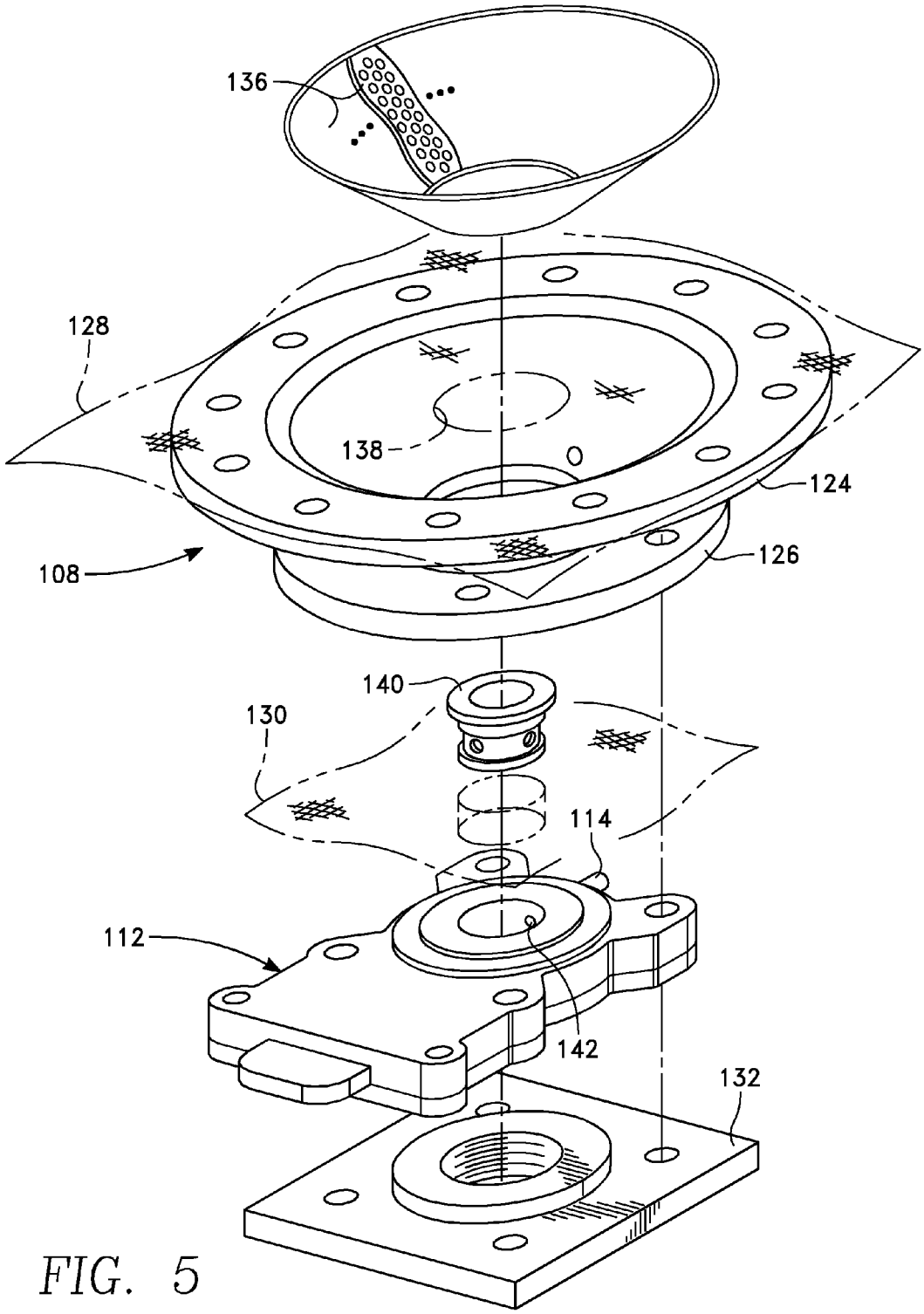
FIG. 5 shows an exploded view of the portion of the binder feeder system shown in FIGS. 3-4.

FIG. 3 depicts an embodiment of the fluidization chamber 108 and actuated valve 112. As shown in FIG. 3, a spacer 122 may be utilized to attach the feeder system 102 to the bottom of the storage pod 100. As shown in FIG. 3, the fluidization chamber 108 may be configured in a bowl shape on the outside, and may contain a cone-shaped internal configuration as shown in FIG. 5. The fluidization chamber 108 may comprise a first flange member 124 which mates to either spacer 122 or directly to the bottom of storage pod 100. Fluidization chamber 108 may further comprise a second flange 126 member for connecting the fluidization chamber to actuated valve 112. A funneled conduit is disposed between the first flange member 124 and the second flange member 126, the funneled conduit comprising the throat opening to the inlet of the actuated valve 112

As shown further in FIG. 3, second air inlet 110 may comprise a nipple which screws directly into a threaded port in the fluidization chamber 108. Likewise, third air inlet 114 may comprise a nipple which threads into the body of actuated valve 112. FIG. 3 also shows the edges of a first cloth membrane 128 which may be disposed between the first flange member 124 of fluidization chamber 108 and either spacer 122 or the overlying storage pod 100. FIG. 3 shows the protruding edges of second cloth membrane 130 which is disposed between the second flange member 126 and the actuated valve 112. FIG. 3 also shows exit port plate 132 which makes up to the discharge side of actuated valve 112. A connector 134 leads to feeder line 118, as shown in FIG. 2.

Figure 4:
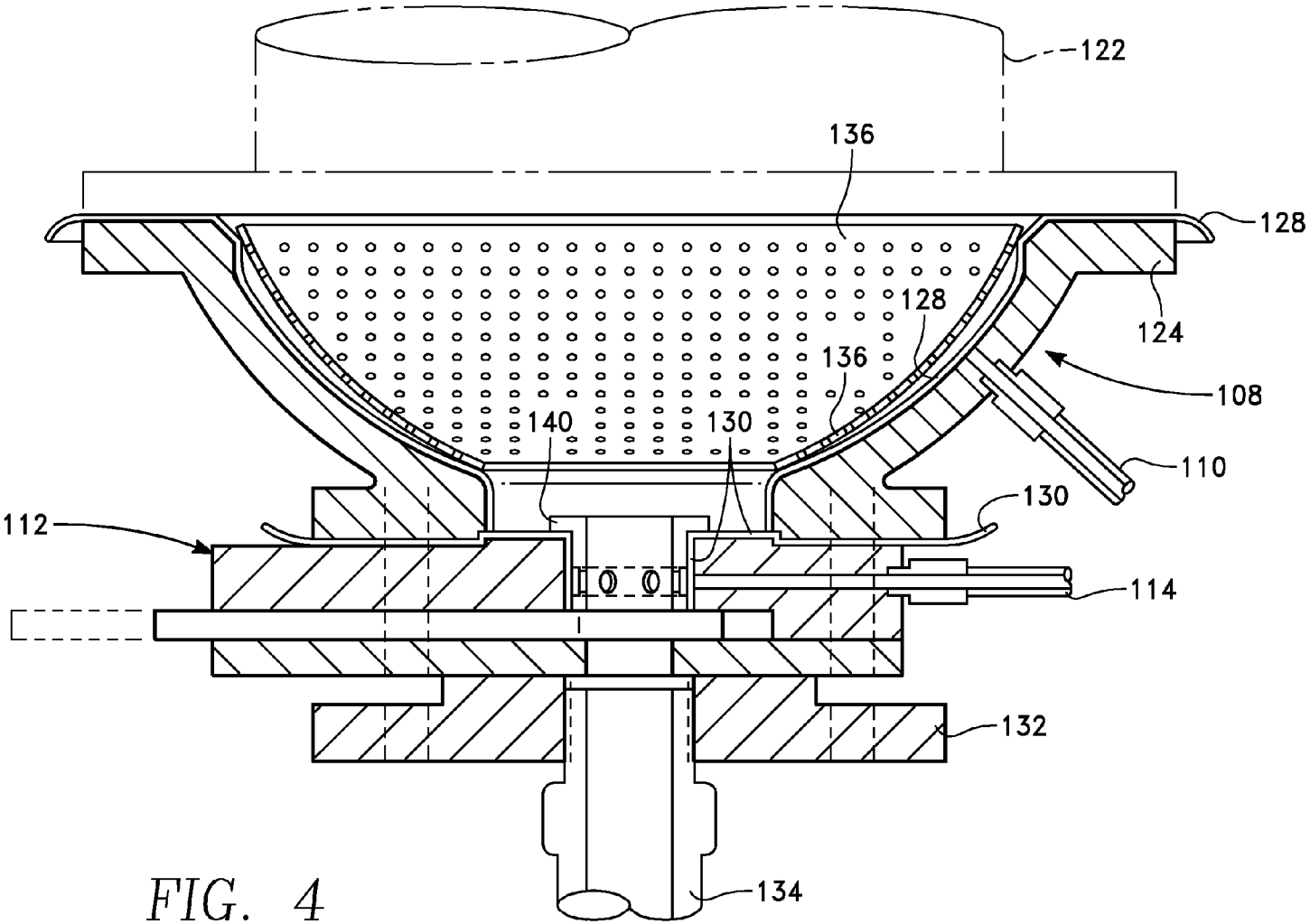
FIG. 4 shows a cross-sectional view of the binder feeder system shown in FIG. 3.

FIG. 4 shows a sectional view of the assembly depicted in FIG. 3. As shown in FIG. 4, first cloth member 128 acts to disperse the air injected from second air inlet 110, thus assisting in the fluidization of binder which enters the fluidization chamber 108 from the upper chamber of storage pod 100. First cloth member 128 lines the inside cone of fluidization chamber 108. Fluidization chamber 108 may further comprise a screen member 136 which conforms to the shape of the inside cone of the fluidization chamber 108, and overlies first cloth member 128, as shown in FIGS. 4 and 5. Alternatively, first cloth member 128 may overlay screen member 136. As shown in FIG. 5, first cloth member 128 comprises an opening 138 which aligns with the opening at the bottom of the fluidization chamber 108. The edges of the opening 138 may be retained by the corresponding edges in the opening of screen member 136. Thus air which is injected through second air inlet 110 is dispersed by both the screen member 136 and the first cloth member 128.

FIG. 4 also shows how a ported bushing 140 is disposed within the throat of actuated valve 112. As further shown in FIG. 4, second cloth member 130 is placed between fluidization chamber 108 and actuated valve 112. Second cloth member acts to disperse the air injected from third air inlet 114. As shown in FIG. 5, an entry port 142 in the housing of actuated valve 112 allows air to be injected into the throat of the valve. This air is first dispersed by second cloth member 130, before entering the ports of ported bushing 140. As shown in FIG. 4, the edges of second cloth member 130 extend downwardly into the throat of actuated valve 112, and may form a pocket as around the bushing as shown in FIG. 5, forming a permeable membrane between the throat of the valve and third air inlet 114. Thus, additional air is dispersed in the throat of actuated valve 112 to maintain the fluidized nature of the binder as it is dispersed from the storage pod 100 into the feeder line 118. It should be noted that the air injected into third air inlet 114 may be at the same pressure as that injected into second air inlet 110, or may be injected at a lower pressure, including that of the injection pressure of first air inlet 106.

The configuration of the first cloth member 128 and the second cloth member 130 creates a localized zone of higher pressure than is present in the substantial remainder of the storage pod 100, thereby creating a pressure differential between the fluidization chamber 108 and the feeder line 118 when actuated valve 112 is opened, because the feeder line is maintained at the same pressure as the pressure in most of the storage pod 100. This pressure differential enhances the fluidizing of the binder contained within the fluidization chamber 108, and reduces or eliminates the problems associated with the existing feeder systems discussed above.

Figure 6:
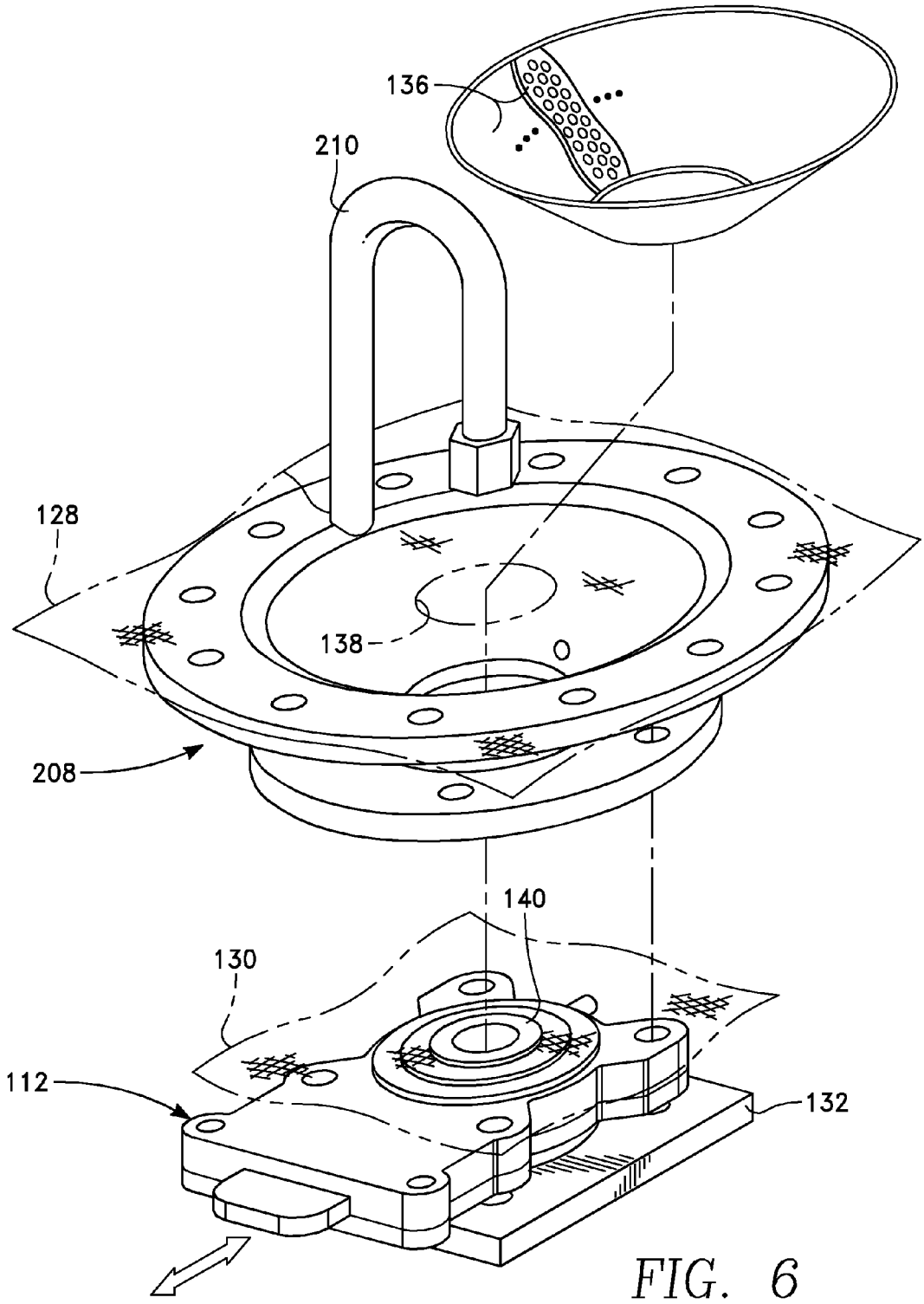
FIG. 6 shows an exploded view of an alternative embodiment of the apparatus shown in FIG. 5.

FIG. 6 shows an alternative embodiment for a fluidization chamber 208. In this embodiment, air from second air inlet 110 enters into the fluidization chamber 208 through a goose neck conduit member 210. The first cloth member 128 and the second cloth member 130 are assembled in a similar fashion as with the embodiment shown in FIG. 5. The apparatus described above suggests a method for delivering fluidized binder from a storage pod to a borehole for creation of an in-situ piling. The method comprises the steps of first injecting air into the upper chamber of the storage pod 100 at a first pressure $P_1$. This injection causes a substantial volume of the storage pod to have this first pressure, referred to as Zone 1. The storage pod 100 also comprises a fluidization chamber 108 below the upper chamber, where the fluidization chamber has an upper end connected to the upper chamber and a lower end. Air is injected into the fluidization chamber 108, at intervals, at a second pressure $P_2$ which is higher than the first pressure $P_1$. A valve 112 is connected to the lower end of the fluidization chamber 108. This valve 112 is opened at the same intervals that air is injected into the fluidization chamber 108 at the second pressure $P_2$. The valve 112 comprises an inlet and an outlet, where the inlet is connected to the fluidization chamber 108 and the outlet is connected to a feeder line 118, where the feeder line is maintained at the first pressure $P_1$ and the feeder line is connected to a hose 16 for transport to a bore tool 10. A first cloth member 128 may be disposed between the upper chamber of the storage pod 100, which cloth member acts to disperse the air injected from second air inlet 110. Air may also be injected into the throat of the actuated valve 112 through third air inlet 114 at the same time air is injected into the fluidization chamber 108. The air injected into third air inlet 114 may either be at first pressure $P_1$, second pressure $P_2$, or some pressure between the first pressure and the second pressure.

While the above is a description of various embodiments of the present invention, further modifications may be employed without departing from the spirit and scope of the present invention. Thus the scope of the invention should not be limited according to these factors, but according to the following appended claims.

What is claimed is:

1. A method of delivering fluidized binder from a storage pod to a borehole for creation of an in-situ piling, the method comprising the steps of:

injecting air into an upper chamber of the storage pod at a first pressure;

injecting air into a fluidization chamber disposed beneath the upper chamber at a second pressure, wherein the air is injected into the fluidization chamber at intervals, wherein the second pressure exceeds the first pressure, wherein the fluidization chamber comprises an upper end connected to the upper chamber and a lower end; and opening a valve connected to the lower end of the fluidization chamber at the same intervals the air is injected into the fluidization chamber at the second pressure, the valve comprising an inlet and an outlet, the inlet connected to the fluidization chamber and the outlet connected to a feeder line wherein the feeder line is maintained at the first pressure and the feeder line is connected to the borehole.

2. The method of claim 1 wherein a first air dispersion member is disposed between the upper chamber and the fluidization chamber.

3. The method of claim 1 wherein air is injected into the valve through an inlet in the valve at the same time air is injected into the fluidization chamber.

4. The method of claim 3 wherein the air injected into the valve is injected at the second pressure.

* * * * *